United States Patent [19]

Akunov et al.

[11] 4,034,919

[45] July 12, 1977

[54] AIR-STREAM MILL

[76] Inventors: Viktor Ivanovich Akunov, Nagatinskaya ulitsa, 83, korpus 2, kv. 420; Ivan Timofeevich Blinov, Kutuzovsky prospekt, 30/32, kv. 198; Viktor Fedorovich Boryakov, ulitsa Begovaya alleya, 3, kv. 801; Georgy Vladimirovich Zavadsky, Rizhsky proezd, 7, kv. 79, all of Moscow; Grigory Afanasievich Klimenko, ulitsa Engelsa, 9, kv. 15, Kiev; Grigory Stepanovich Krykhtin, prospekt Lenina, 76/2, kv. 45, Podolsk Moskovskoi oblasti; Nikolai Ippolitovich Ferens, ulitsa Vvedenskogo, 12, korpus 2, kv. 341, Moscow; Alexandr Lvovich Checkik, ulitsa Lenina, 39, kv. 111; Vadim Petrovich Shanin, ulitsa Sverdlova, 4, kv. 20, both of Kiev, all of U.S.S.R.

[21] Appl. No.: 625,768

[22] Filed: Oct. 24, 1975

[51] Int. Cl.[2] ..... B02C 19/06

[52] U.S. Cl. ..... 241/39; 241/80

[58] Field of Search ..... 241/5, 39, 41, 42, 43, 241/45, 80, 15 LA

[56] References Cited

U.S. PATENT DOCUMENTS

| | | | |
|---|---|---|---|
| 2,624,516 | 1/1953 | Andries | 241/39 |
| 2,672,296 | 3/1954 | Venable | 241/39 |
| 3,837,583 | 9/1974 | Kugelberg et al. | 241/5 |
| 3,877,647 | 4/1975 | Gorobets et al. | 241/39 |

*Primary Examiner*—Granville Y. Custer, Jr.

*Attorney, Agent, or Firm*—Robert E. Burns; Emmanuel J. Lobato; Bruce L. Adams

[57] ABSTRACT

An air-stream mill for milling free-flowing, large-lump, solid materials into a particulate condition. The mill has two grinding chambers provided with opposed injectors that impel flows of large-lump, solid materials being delivered into the grinding chambers upstream of the injectors as two opposed, counter flowing streams of a gas-solid mixture of the large-lump materials. The lumps of solid materials in the counter-flowing streams collide internally of the grinding chambers and are converted to free particles of a smaller size. The particles from the grinding chambers leave the grinding chamber as two separate and independent flows which are received upstream of opposed injectors for a milling chamber. The latter injectors deliver the free particles as two opposed, counter-flowing streams of a gas-solid mixture. The solid particles in these streams collide internally of the milling chamber and the particles are converted to a smaller size. The converted particles are delivered as a stream in suspension in a gas-solid mixture to a two-stage separator that has a first stage in which the particles received are separated into coarser and finer particles. The coarser particles are returned upstream of the injectors for the grinding chambers for recycling through the grinding chambers, the milling chamber and the separator. A second stage of the separator receives the finer particles where further separation takes place between finer and finest particles. The finest particles are discharged as finished material in its desired particulate condition. The remaining finer particles are returned upstream of either the injectors for both the grinding chambers or only upstream of those of the milling chamber for recycling thereof.

3 Claims, 2 Drawing Figures

AIR-STREAM MILL

BACKGROUND OF THE INVENTION

The present invention relates to an air-stream mill for free flowing materials, i.e., various ores and nonmetallic minerals, solid fuel, metallurgical compounds, inorganic products of calcination and baking, fertilizers and other chemicals, grain, bones and other materials of vegetable and animal origin.

The present invention can be utilized in power engineering, in mining, metallurgical, construction, chemical and food industries.

The mill according to the invention can be used for grinding materials practically to any size from a decimeter to micron dimensions.

An air-stream mill is known in the art comprising milling injectors facing each other; the material in these injectors is entrained by the gaseous working medium and accelerated to a speed which is near to that of the working medium, and a miling chamber with coaxially built-in injectors. The milling chamber provides for free collisons and crushing of the material being milled.

The known air-stream mill comprises a separator connected with the chamber milling for separating the finished product from the insufficiently ground material. The separator has spaces for separating the coarse and fine fractions of the half-finished product. These spaces are connected by the pipes which carry it for final grinding and are connected with the inlet pipes of the injectors.

The particles of the handled material in the known air-stream mills enter the counter-opposed injectors at atmospheric pressure and are accelerated there by the working medium (gas under pressure). They collide with each other at a high speed in the milling chamber. Thus the particles are disintegrated and discharged from the milling chamber through a central pipe into the separator.

The insufficiently ground particles of the material (half finished product) are separated in the separator from the finished product and return through the descending pipes into the milling injectors for repeated milling. The sufficiently milled material (finished product) is discharged from the separator being suspended in the working medium.

In the known air-stream mill large particles whose size is measured in centimeters cannot be milled since their pneumatic transportation from the milling chamber upward into the separator is limited by their weight.

In the base of the stream of the working medium located near the nozzle the gas density is very high so that introduction into it of the particles of the ground material falling by gravity into the injector is difficult (the material-entraining factor is low). Therefore, the specific consumption of the working medium for milling a unit weight of the material is relatively high.

To assure efficient separation in the separator of the finished finely-ground product from the coarse and fine fractions of the half-finished product all the particles of the material should be dispersed in a large volume of gas and be efficiently blown over by the latter. However, the amount of the working medium required for efficient milling is insufficient for such dispersion. Therefore, the air-stream mills usually utilize outside air drawn into the injectors or into the central pipe, said air being cheaper than the working medium but requiring for its movement along the entire mill duct and, often, for heating it to the ambient temperature, additional expenditures of the working medium and an increase in the power of the fan which discharges the used working medium from the mill.

The disadvantages quoted above limit the use of the air-stream mills for lump source materials whose crushing involves heavy material expenditures, in spite of the fact that these mills are efficient in some respects.

SUMMARY OF THE INVENTION

The main object of the invention is to provide an air-stream mill which would ensure milling of large lump materials at a relatively low specific consumption of the working medium and producing a material with a high degree of fineness with relation to the source material.

This and other objects are achieved by providing an air-stream mill wherein, according to the invention, there is at least one pair of grinding chambers installed on the opposite sides of the milling chamber. The grinding chambers accommodate counter-opposed grinding injectors which are connected with the milling chamber in such a manner that the outlet connections of the grinding chambers are connected with the inlet pipes of the milling injectors whereas the grinding injectors are connected with the separator through its pipes for discharging the half-finished product.

If it is required to grind the source material to a particularly high degree of fineness, it is practicable that the grinding injectors should be connected with the separator space for separating the coarse fraction of the half-finished product and the milling injectors, with the space for separating the fine fraction of the half-finished product of the same separator.

The essence of the present invention consists in the following.

Owing to the fact that the air-stream mill has at least one pair of grinding chambers installed on the opposite sides of the milling chamber and provided with counter-opposed grinding injectors, it has become possible, before fine milling of the material, to use the same mill for preliminary crushing of the coarse inclusions contained in the material.

The grinding chambers serve as this means for preliminary crushing of large material lumps and thus make the grain composition of the material more homogeneous before its fine disintegration in the milling chamber; this makes it possible to use the mill for milling the large-lump materials at a relatively low consumption of the working medium and producing the material with a high degree of fineness.

The grinding chambers are arranged in pairs because each chamber works in conjuction with a separate milling injector and the injectors should always be installed in pairs for creating the counterflows of the material being milled in the milling chamber.

The use of a single-grinding chamber in the air-stream mill with subsequent distribution of the crushed product among the milling injectors is impossible as this would increase the height of the pipe connecting the milling chamber with the separator and thus eliminate the possibility of pneumatic transportation of coarse fractions through the pipe.

If the air-stream mill comprises several pairs of milling injectors (arranged in a crosswise or star-shaped manner in plan) this increases correspondingly the number of pairs of the grinding chambers.

The milling chamber is connected with the grinding chambers by connecting the outlet pipe of each grinding chamber with the inlet pipe of its corresponding milling injector. The grinding injectors are connected with the separator which receives the material disintegrated in the milling chamber. The material is delivered into the separator through a pipe, usually a vertical one. The grinding injectors communicate with the separator through its pipes for discharging the half-finished product.

This connection of the above-listed units of the mill ensures disintegration of the entire material to the required degree of fineness in the course of its successive, usually repeated, movement through the grinding and milling chambers with gradual separation of the finished product in the separator which is common for all the milling chambers.

The connection of the grinding chamber outlet pipe with the inlet pipes of the milling injectors provides for using the working medium which has already worked in the grinding injectors in order to increase the entraining factor of the milled material in the milling injectors, to raise the velocity of the flow between the grinding chambers and the separator and to increase the separator efficiency.

The working medium that has already worked in the grinding injectors passes through the above-mentioned pipes of the grinding chamber and milling injector, accelerates the particles of the material and increases the number of said particles penetrating into the dense stream of the working medium discharged from the milling injector nozzle so that the number of these particles becomes larger than in the air-stream mills in which the material falls freely on the stream of the working medium.

Connecting the outlet pipes of the grinding chambers with the inlet pipes of the milling injectors increases at least twice the velocity of the working medium with the suspended material in the milling chamber and in the pipe connecting the milling chamber with the separator. This is explained by the fact that the working medium that has passed through the grinding chambers is added to the working medium entering the milling injectors. The higher velocity of the working medium with the suspended material rules out clogging of the milling chamber with large lumps and improves their pneumatic transportation through the vertical pipe.

The increased volume of gas in the separator improves the separation of material particles in it, and reduces the amount of the finished product entrained by the particles of the half-finished product for final disintegration. This increases the efficiency of the separator, vocating a part of the milling duct for passing an additional amount of the source material and reducing the circulation ratio, i.e., the average number of times the material passes through the mill units to the state of complete disintegration.

The decrease in the circulation ratio makes it possible, in turn, to reduce the size of the separator and the diameter of the pipes through which the half-finished product is returned for final disintegration.

All the above-mentioned advantages attained in the air-stream mill by use of grinding chambers with grinding injectors and by connecting the outlet connections of said grinding chambers with the inlet connections of the milling injectors result in a low consumption of the working medium and electric power for fine milling of large-lump (coarse-grained) material and, consequently, in a low cost of such milling and a reduction in the number of attending operators. Thus, if milling of hard lump rocks in the known air-stream mill utilizing preliminary grinding in an electric-driven grinder requires 0.6 *t* of steam and 1–3 kW of electric power per 1 *t* of fine-ground rock flour, the air-steam mill according to the invention will use only 0.5 *t* of steam and no additional electric power for producing 1 *t* of the same rock flour. Besides, there is no need for a second machine (grinder) with electric drive, quick-wearing grinding elements, bearings, friction clutch, speed reducer and additional operating personnel.

Such factors as the use of a gaseous working medium, mostly a high-temperature one, treatment of the material in the suspended state, cleanliness and a high chemical activity of the surface of the material newly formed in the process of disintegration allow the air-stream mill according to the invention to be used for combining two and more technological operations. For example, milling can be efficiently combined with simultaneous drying and heating of the material which is attained particularly by the longer time spent by the treated material in working medium than in the known air-stream mills. This becomes possible because, apart from the milling injectors and milling chamber, the air-stream mill according to the invention comprises grinding injectors and chambers whose outlet connections are in communication with the inlet connections of the milling injectors. Such a mill is particularly efficient for combining milling with mixing and homogenizing various materials, separating the product into fractions of various grain sizes, treating them with reagents, etc.

The use of the air-stream mill according to the invention reduces the cost of milling by 15–30% as compared with the known mills while combination of two or more technological operations reduces their total cost two or three times.

BRIEF DESCRIPTION OF THE DRAWINGS

To make the essence of the invention more apparent, the description is accompanied by drawings illustrating an air-stream mill used for milling with simultaneous mixing and partial drying of the cement clinker, gypsum with natural mositure content, and aggregate, (i.e. granualted metallurgical slag) batched in the required proportions. The size of particles in this mixture reaches 100 mm in diameter.

The working medium in this case is superheated steam.

DESCRIPTION OF THE PREFERRED EMBODIMENT

Figure 1:
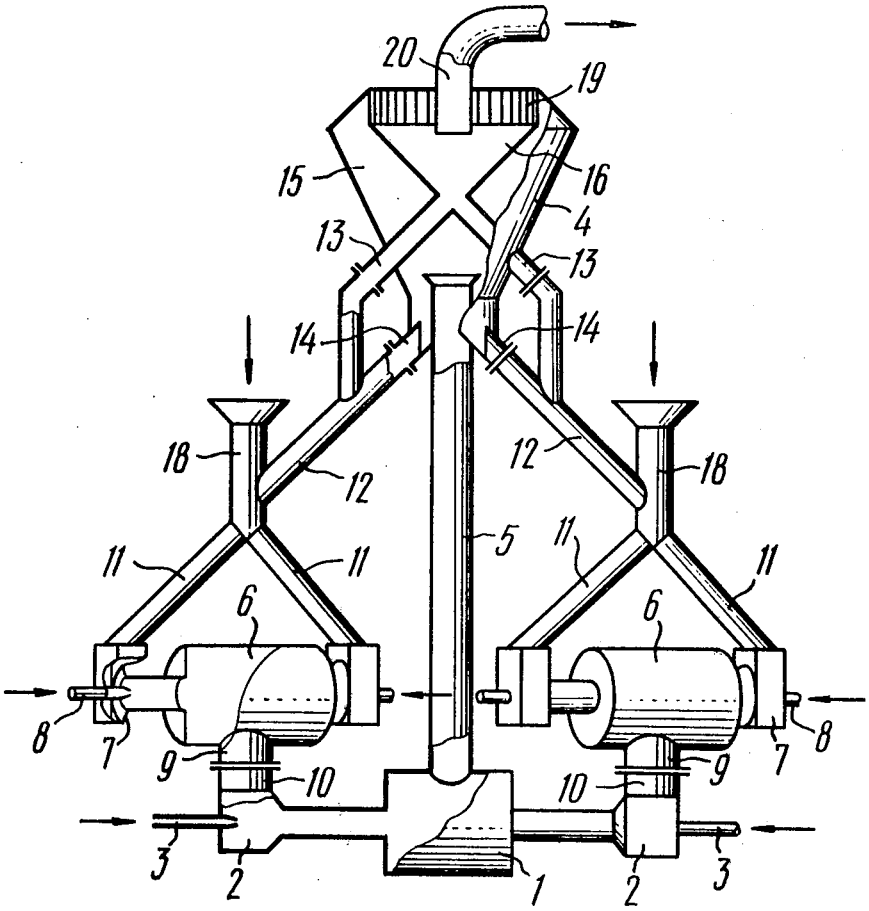
FIG. 1 is a side view of the air-stream mill units, partly cut-away according to the invention.

The air-stream mills shown in the drawing each comprises a milling chamber 1 (FIG. 1, 2 wherein some reference numerals correspond to similar parts for ease of explanation and comparison), two milling injectors 2 built into this chamber, facing each other and provided with nozzles 3 for admitting the working medium, a separator 4 communicating with the milling chamber 1 through a vertical pipe 5 and a pair of grinding chambers 6 each provided with built-in grinding injectors facing each other and incorporating nozzles 8 for the admission of a working medium.

The grinding chambers 6 are installed on the opposite sides of the milling chamber 1 and communicate with the latter as follows: the outlet connection 9 of each grinding chamber 6 communicates with the inlet connection 10 of each milling injector 2 while the grinding injectors 7 of each grinding chamber 6 are interconnected by pipes 11 with each other while pipes 12 put them in communication with the separator 4. The pipes 12 communicate with pipe connections 13 and 14 intended to discharge the half-finished product for final disintegration from the separator spaces 15 and 16 which separate the coarse and fine fractions of the half-finished product, respectively.

In another version of the air-stream mill, the space 16 of the separator 4 for separating the fine fraction of the half-finished product communicates through pipes 17 (FIG. 2) with the inlet connections 10 of the milling injectors 2. In this case the grinding injectors 7 are connected only with the space 15 of the separator 4 which separates the coarse fraction of the half-finished product.

This connection is ensured by pipes 12' through pipe connections 14.

The mixture of the cement clinker, gypsum and granulated slag enters the grinding injectors through chutes 18, (FIG. 1, 2) and pipes 11.

Superheated steam discharged from the nozzles 8 under a pressure of 0.05–50 atm. gauge entrains the lumps of the material, accelerates them in the grinding injectors and carries them at a high velocity into the grinding chambers 6. In each grinding chamber 6 the lumps of the material directed by the counter-opposed injectors 7 collide with one another and are thus disintegrated. The aerated mixture formed by the disintegrated material and by the superheated steam discharged from the injectors is expelled from the grinding chambers 6 through pipe connections 9 and enters the milling injectors 2 through their connections 10.

A considerable speed at which the ground mixture enters the milling injectors is produced on the one hand due to the discharge of the suspended particles in the superheated steam flowing at a high velocity from the grinding chambers, and, on the other hand, due to the gravity forces; this speed increases the entrainment factor of the milled material by the streams of steam delivered through the nozzles 3 thus reducing the specific consumption of steam.

The particles of the ground mixture entrained by steam are again accelerated and carried at a high speed from each injector 2 into the milling chamber 1; here they collide with the particles discharged from the counter-opposed injector, are again disintegrated and mixed even more uniformly after which they are carried by the expended steam into the pipe 5.

On entering the space 15 of the separator 4 the aerated mixture loses its speed; as a result, the coarse fraction of the homogenized mixture of the source materials precipitates from the total flow of the material in the form of particles whose size is measured in millimeters. The precipitated material moves out through the lower pipe connections 14 provided for discharging the half-finished product and returns into the grinding injectors 7 through the pipes 12 and 11 for final disintegration.

Having passed through a swirler 19 into the space 16 of the separator 4 the aerated mixture begins rotating intensively and is separated from the fine fraction of the half-finished product whose particles are measured in fractions of a millimeter. This fraction settles on the walls of the space and is removed from the separator through the upper pipe connection 13 used for discharging the half-finished product. Then the fine fraction gets mixed with the coarse fraction in the pipes 12 and 11 and returns into the grinding injectors 7.

The homogenized and finely-disintegrated finished product (cement) is freed from the insufficiently disintegrated particles in the spaces 15 and 16 of the separator 4 and is discharged from the mill through the pipe connection 22 used for discharging the finished product after which it is conveyed pneumatically, being suspended in the used steam, to the point of storage or utilization.

Figure 2:
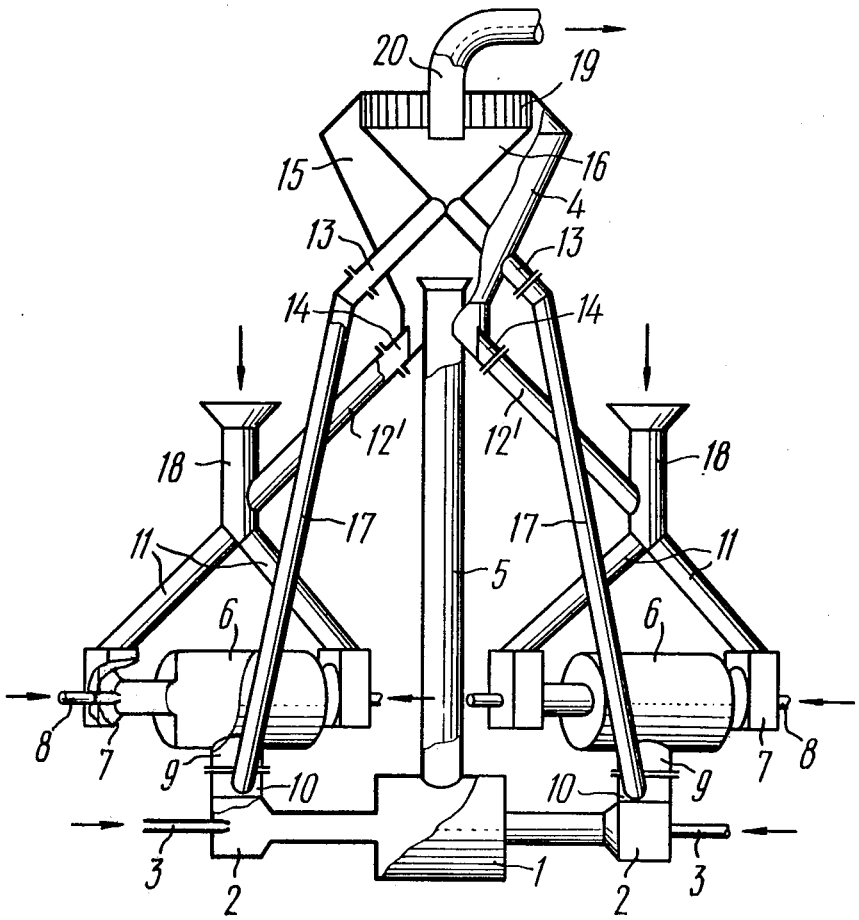
FIG. 2 is a side view of another embodiment of the invention.

For viscous hard-to-mill clinkers it is practicable that the air-stream mill should be realized according to the version shown in FIG. 2. Here, the coarse fraction of the half-finished product returns from the space 15 of the separator 4 through pipes 12' and 11 into the grinding injectors 7 for regrinding. The fine fraction of the half-finished product returns through pipes 17 from the space 16 of the separator 4 directly into the milling injectors 2 past the grinding injectors 7 and chambers 6. In this embodiment of the mill the hard-to-mill large particles are subjected to two successive stages of disintegration in chambers 6 and 1 during each milling cycle before entering the vertical pipe 5 and separator 4; the fine particles which require milling alone are not directed into the grinding chambers 6 after the preliminary sizing in the separator 4, thus facilitating disintegration of the large lumps of viscous clinker in said grinding chambers 6.

What we claim is:

1. An air-stream mill for milling free-flowing, solid materials into a particulate condition comprising, means for defining two grinding chambers for each receiving therein in operation, large-lump, solid materials to be converted into free particles, means for introducing large-lump solid material into said grinding chambers as two separate flows, opposed injector means for each grinding chamber for impelling lumps of solid material in said flows as two opposed, counter-flowing streams each of a gas-solid mixture to convert the solid material in the streams into free particles by impingement of solid material in the streams against each other internally of a corresponding grinding chamber, means for defining a milling chamber for receiving solid material in a particulate condition from the two grinding chambers as two separate and independent flows, means for delivering particulate solid material from said grinding chambers to said milling chamber as two independent flows, opposed injector means for said milling chamber for impelling the particulate solid material in the last-mentioned two flows as opposed, counter-flowing streams each of a gas-solid mixture to impel the solid material particles in the streams against each other internally of the milling chamber to convert the particles received into smaller size particles, a two-stage separator for receiving the particles of solid material from said milling chamber in suspension in a stream of a gas-solid mixture and having means defining two-stages for separating the particles received into coarser and finer particles, means to deliver the particles from said milling chamber to said separator as a gas-solid mixture as a stream with particles in suspension therein, means in communication with a first stage of said separator to return the coarser particles to both the first-mentioned two flows for re-entry into said injector means for said grinding chambers for recycling through said grinding chambers, said milling chamber and said two-stage separator, means in a second stage of said separator for separating from the finer particles the finest particles and for discharging from the separator the finest particles as a flow of a finished material in a desired particulate condition, and means in communication with said second stage for delivering from the second stage the remaining finer particles separated from said finest particles and returning them for re-entry at least into said injector means of said milling chamber for recycling thereof through at least said milling chamber and said separator.

2. An air-stream mill for milling free-flowing, solid materials into a particulate condition according to claim 1, in which said means in communication with said second stage comprises means for delivering said finer particles separated from the finest particles to the first-mentioned separate flows upstream of the opposed injector means for each grinding chamber for recycling of said finer particles through said grinding chambers, said milling chamber and said separator.

3. An air-stream mill for milling free-flowing, solid materials into a particulate condition according to claim 1, in which said means in communication with said second stage comprises means for delivering said finer particles separated from the finest particles to said last-mentioned two flows upstream of the opposed injector means for the milling chamber for recycling of said finer particles only through said milling chamber and said separator.

* * * * *